US006935387B1

(12) United States Patent
Blubaugh

(10) Patent No.: US 6,935,387 B1
(45) Date of Patent: Aug. 30, 2005

(54) ODOR CONTROL ASSEMBLY

(75) Inventor: Daniel L. Blubaugh, Findlay, OH (US)

(73) Assignee: Marathon Ashland Petroleum LLC, Findlay, OH (US)

( * ) Notice: Subject to any disclaimer, the term of this patent is extended or adjusted under 35 U.S.C. 154(b) by 0 days.

(21) Appl. No.: 10/894,173

(22) Filed: Jul. 19, 2004

(51) Int. Cl.[7] ..... B65B 1/04
(52) U.S. Cl. ..... 141/59; 141/286
(58) Field of Search ..... 141/44, 45, 59, 141/286, 1; 55/385.1

(56) References Cited

U.S. PATENT DOCUMENTS

| | | | | |
|---|---|---|---|---|
| 4,875,914 | A | 10/1989 | Wireman | |
| 5,271,767 | A | 12/1993 | Light, Sr. et al. | |
| 5,507,326 | A | 4/1996 | Cadman et al. | |
| 5,948,146 | A | 9/1999 | Thomaides et al. | |
| 6,099,616 | A | 8/2000 | Jenne et al. | |
| 6,245,217 | B1 | 6/2001 | Jenne et al. | |
| 6,461,421 | B1 | 10/2002 | Ronvak | |
| 6,528,047 | B2 | 3/2003 | Arif et al. | |
| 6,589,323 | B1 | 7/2003 | Korin | |
| 6,659,143 | B1 | 12/2003 | Taylor et al. | |
| 6,709,637 | B2 | 3/2004 | Byrne | |
| 6,772,741 | B1 * | 8/2004 | Pittel et al. | 123/519 |
| 6,835,223 | B2 * | 12/2004 | Walker et al. | 55/385.1 |

* cited by examiner

*Primary Examiner*—Steven O. Douglas
(74) *Attorney, Agent, or Firm*—Emch, Schaffer, Schaub & Porcello Co., L.P.A.

(57) ABSTRACT

This assembly is an apparatus for recovering vapors during the dispensing of fluids from a storage tank to a receiving tank. More specifically, the assembly reduces odors from storage tanks and loading facilities at asphalt terminals. A dual carbon system was installed for the tanks and the loading rack. The system was operated continuously at a low flow rate to handle stray vapors from the tanks when they are not being filled. The system would be turned to a high flow rate whenever the tanks are receiving product. The blowers on this system are run at a speed proportional to the number of loading arms being used, based on vacuum transmission.

18 Claims, 5 Drawing Sheets

ODOR CONTROL ASSEMBLY

TECHNICAL FIELD

This invention relates to recovering vapors during the dispensing of fluids from a storage tank to a receiving tank. More specifically, the invention relates to the recovery of volatiles during transfer from one tank to another storage tanks and loading lanes at asphalt terminals.

BACKGROUND OF THE INVENTION

Tanks used for storing or transporting flammable fluids such as gasoline, diesel fuel and other petroleum products are often equipped with protection devices. When the fluids are being transferred from the storage tanks to recipient tanks, these devices detect when the recipient tanks are full and automatically disable the transfer process. Tanks can be mounted on tanker trucks or located underground at service stations. Tanker trucks are typically filled with the fluids using pumping equipment at the loading racks of marketing terminals, and underground storage tanks are typically gravity-filled from the trucks.

Asphalts also are transferred in a similar fashion. Asphalts are well known and widely used in a variety of products. While asphalts are primarily composed of high molecular weight hydrocarbons, they invariably contain minor amounts of low molecular weight hydrocarbons exhibiting substantial volatility. As such, the manufacture, storage and transportation of asphalt materials present opportunities for escape of the volatile, organic components (VOCs) into the atmosphere.

Odor control and fume recovery would be highly desirable. A wide variety of systems exist for treating asphalt vapors. These systems collect, adsorb, absorb, oxidize, react, suppress or perfume the asphalt vapors. Additives such as citrus terpenes and cherry odor additives merely mask the problem. Other systems require complicated recovery equipment.

BRIEF DESCRIPTION OF THE INVENTION

Our novel invention provides for odor control by using multistage systems during truck loading and storage tank operations. The system was conceived and designed to remove and treat vapors released during asphalt truck loading operations and from the asphalt storage tanks.

The design involves the use of variable speed blowers, vapor stream pre-filters, arrestors and end carbon filtration coupled to the loading spouts to capture the maximum amount of vapors generated during the truck loading process. The system is controlled by a PLC program utilizing a series of pressure and temperature instruments. These provide feedback for variable blower speeds to minimize power consumption and provide continuous air purge across the carbon filtration beds and prolong the life of the final carbon bed filtration system. The system places a continuous vapor pull from existing asphalt storage tanks. It also increases or decreases the air flow based on loading demand at all loading positions at the terminal.

In the preferred embodiment, the tank and truck systems are combined. However, a single carbon system may be used for the tanks. The tank and truck system will operate continuously at a low flow rate to handle stray vapors from the tanks when they are not being filled. The system, based on vacuum transmitter, would be turned to a high flow rate whenever the tanks are receiving product. The collection ductwork will allow the tank to breathe regardless of the odor control device.

In the preferred embodiment, a dual carbon system is used for the tank and the loading rack. The loading rack system will operate on an as-needed basis. The blowers will be run to maintain vacuum at a speed proportional to the number of loading arms being used. The vapor collection system at the truck will consist of a concentric pipe around the loading spout with partial cover over the truck opening and flexible ductwork to the main collection ductwork. Actuated valves will automatically open when loading operations start and automatically shut when the loading operation is complete.

Both systems will use two initial stages of filtering to knock out most of the heavy vapors prior to running through the filters. This will increase the life of the carbon. These filters consist of a coarse mesh pre-filter and a coalescing type filter.

DETAILED DESCRIPTION OF THE INVENTION

Figure 1:
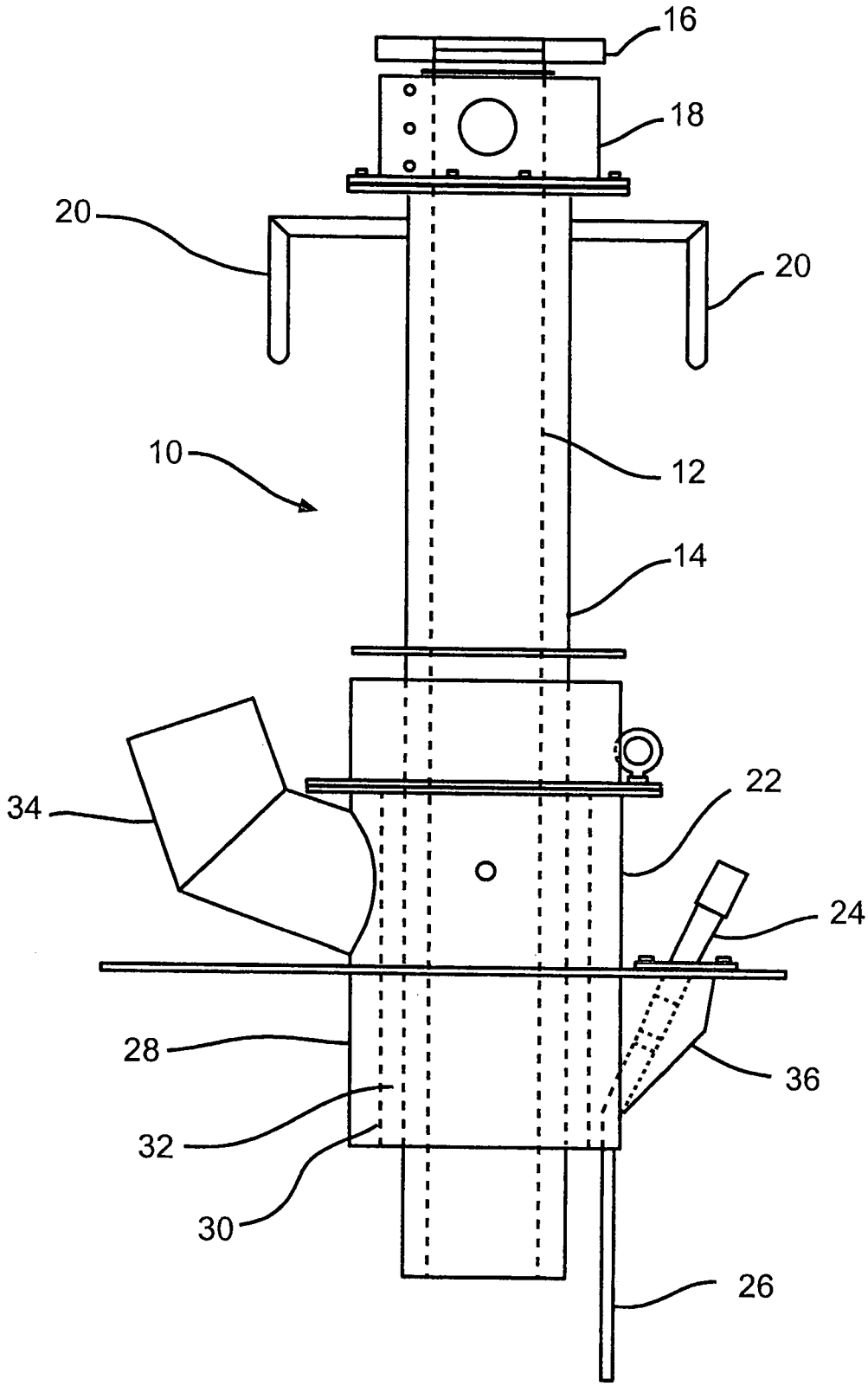
FIG. 1 is a side view of a telescopic drop tube assembly used with the odor control assembly of this invention.

FIG. 1 is a side view of the telescopic drop tube assembly of this invention showing the tubes in a retracted position. FIG. 1 shows drop tube assembly 10, which includes first hollow tube 12 and second hollow tube 14. Coupling 16 connects tube 12 a liquid source (not shown). Fitting 18 attaches to the upper end of tube 14. Fitting 18 and tube 14 circumscribe tube 12 and are slidably mounted around the exterior of tube 12. Preferably, filling 18 is collar threaded SST for easy access to the guides. Handles 20 typically are one inch aluminum rods for moving tube 14 upwardly or downwardly along tube 12. Movement may be manually or automated with electronic or mechanical means.

Spout 22 is connected to the lower end of tube 14. Spout 22 rests over a truck opening. Spout 22 partially or completely covers the truck opening. Fluid overfill detector probe 24 is connected to spout 22. Probe 24 includes sensor pipe 26. Probe 24 and sensor pipe 26 detects a fluid state of their environment. Probe 24 and pipe 26 are a one piece device. Probe electronics connects probe 24 to a PLC via conventional electrical cable. The monitor may provide a signal for detecting a fluid environment or it may automatically shut off the flow of fluid.

Spout 22 also comprises a pair of hollow tubes with a void therebetween. Spout 22 comprises exterior tube 28, interior tube 30 and void 32 therebetween. Vapor recovery nozzle 34 connects to exterior tube 28 and communicates with void 32. Vapor recovery nozzle connects to a vapor recovery manifold via a vapor recovery hose.

FIG. 1 also shows probe protector plate 36.

The telescopic drop tube assembly is further described in copending patent application Ser. No. 10/894,373, filed Jul.

19, 2004, a date even herewith, entitled Drop Tube Assembly, the disclosure of which is herein incorporated by reference.

Figure 2:
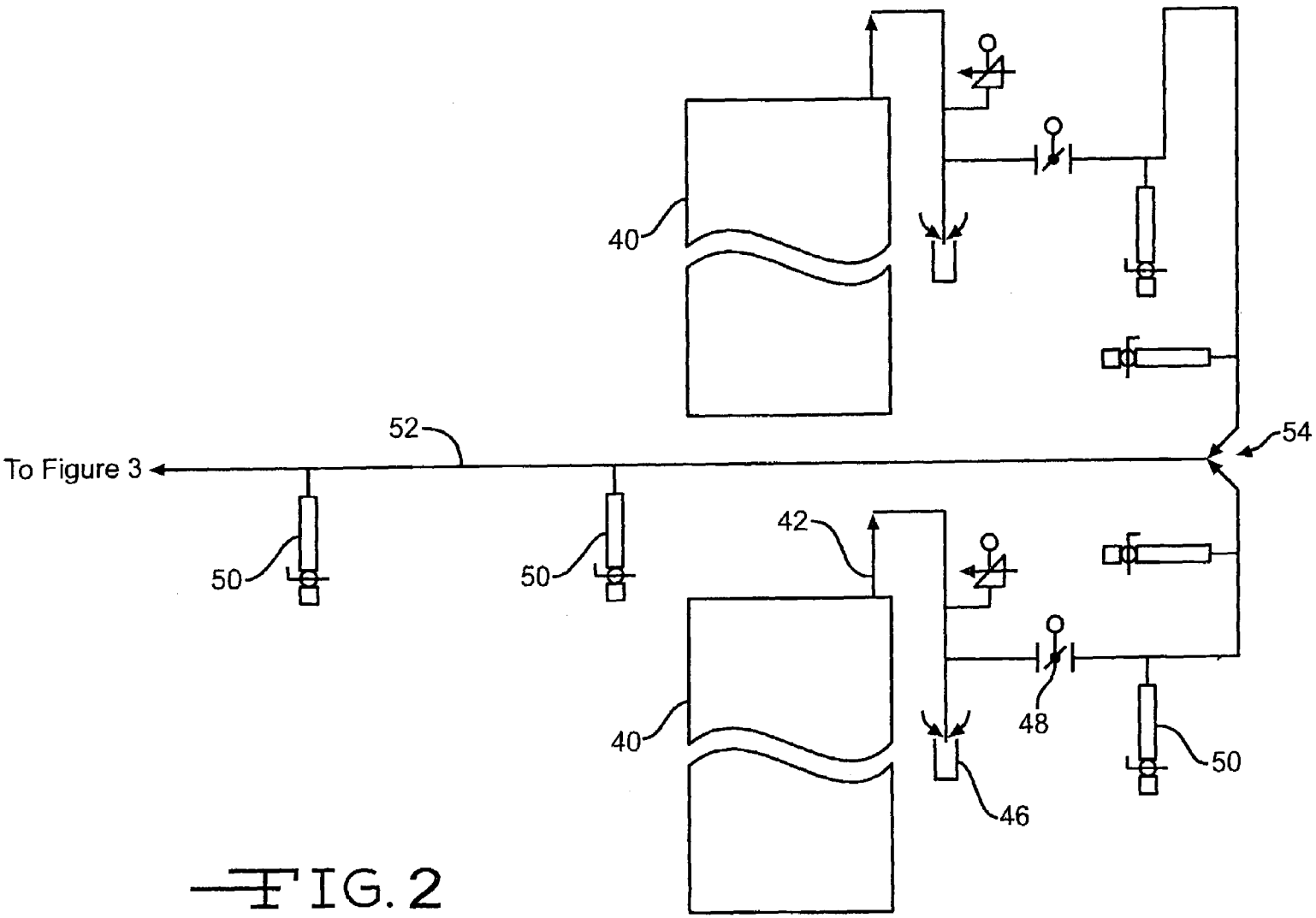
FIG. 2 is a schematic view of the storage tank and carbon adsorption system of this invention.

FIG. 2 is a schematic view of the storage tank and carbon adsorption system of this invention. Storage tank 40 is vented by conduit 42. Conduit 42 includes vacuum relief set valve 44 and air bleed dilution open pipe 46. Flow control valve 48 is used to maintain vacuum on the tanks and at least one drain valve 50. Conduit 52 and tee connection 54 in the piping complete the system. Typically, all the tanks may be vented via conduit 52 at the same time. Typically, only one tank will be filled at a time.

Figure 3:
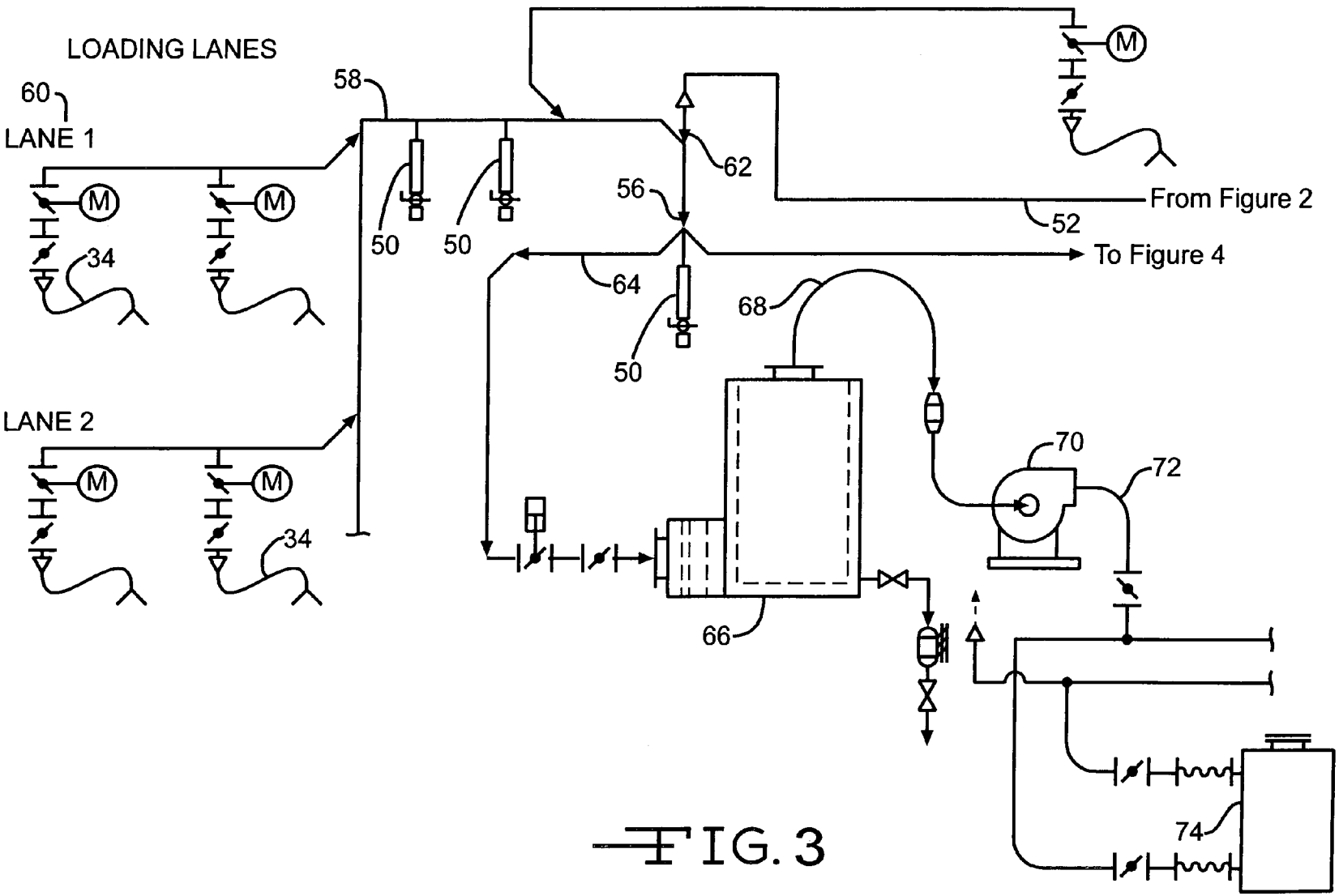
FIG. 3 is a schematic view of the loading rack carbon adsorption system of this invention.

FIG. 3 is a schematic view of the loading rack carbon adsorption system of this invention. Conduit 52 from storage tank 40 of FIG. 2 enters the system via tee connection 62 and 56. Conduits 58 transports vapor from loading lane 60 also enters the system via tee connection 62 and 56. Conduit 58 connects valve 62 with vapor recovery nozzle 34 of spout 22 of drop tube assembly 10 of FIG. 1 at loading lane 60. Conduit 64 connects tee 56 with mist eliminator 66. Ductwork 68 connects eliminator 66 to blower 70. Ductwork 72 connects blower 70 to carbon canister 74. As can be appreciated a multiplicity of loading lanes 60 may be vented with a multiplicity of eliminators 66, blowers 70 and carbon canisters 74. In one embodiment, two vapor recovery units can service eight loading lanes and two storage tanks. A plurality of drain valves 50 also are shown. A conduit also transports vapor from tee 56 to prefilter 80 in FIG. 4.

Figure 4:
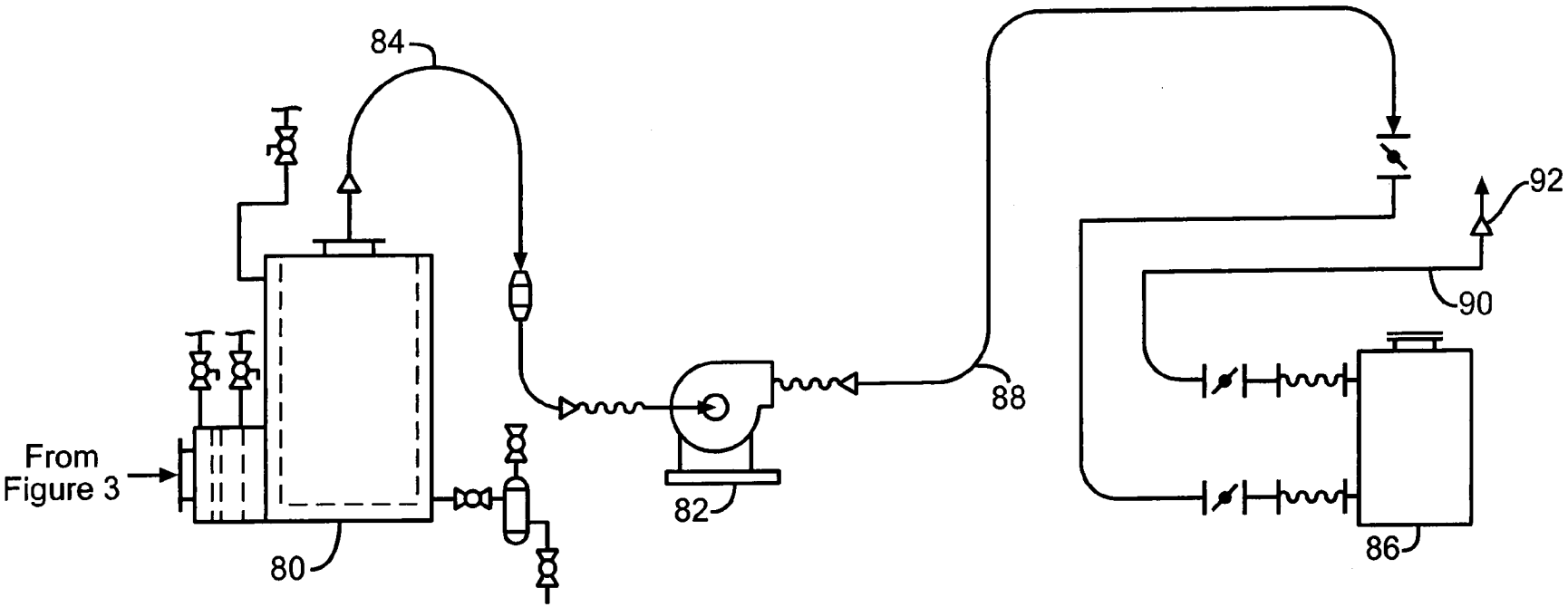
FIG. 4 is a schematic view of the prefilter and blower system of the invention.

FIG. 4 is a schematic view of the prefilter and blower system of the invention. Fumes from loading arms 10 at loading lanes 60 enter prefilter 80. This is done through a conduit from tee 56 in FIG. 3. Prefilter 80 is a coarse mesh filter, which removes large particles and condensed droplets. Blower 82 pulls the remaining fumes from prefilter 80. Conduit 84 connects prefilter 80 and blower 82. From blower 82, the remaining fumes enter carbon canister 86. Canister 86 removes condensed vapors and particles down to plus-micron sizes. Conduit 88 connects blower 82 and canister 86. Conduit 90 and vent stack diffuser remove the remaining fumes from canister 86.

Figure 5:
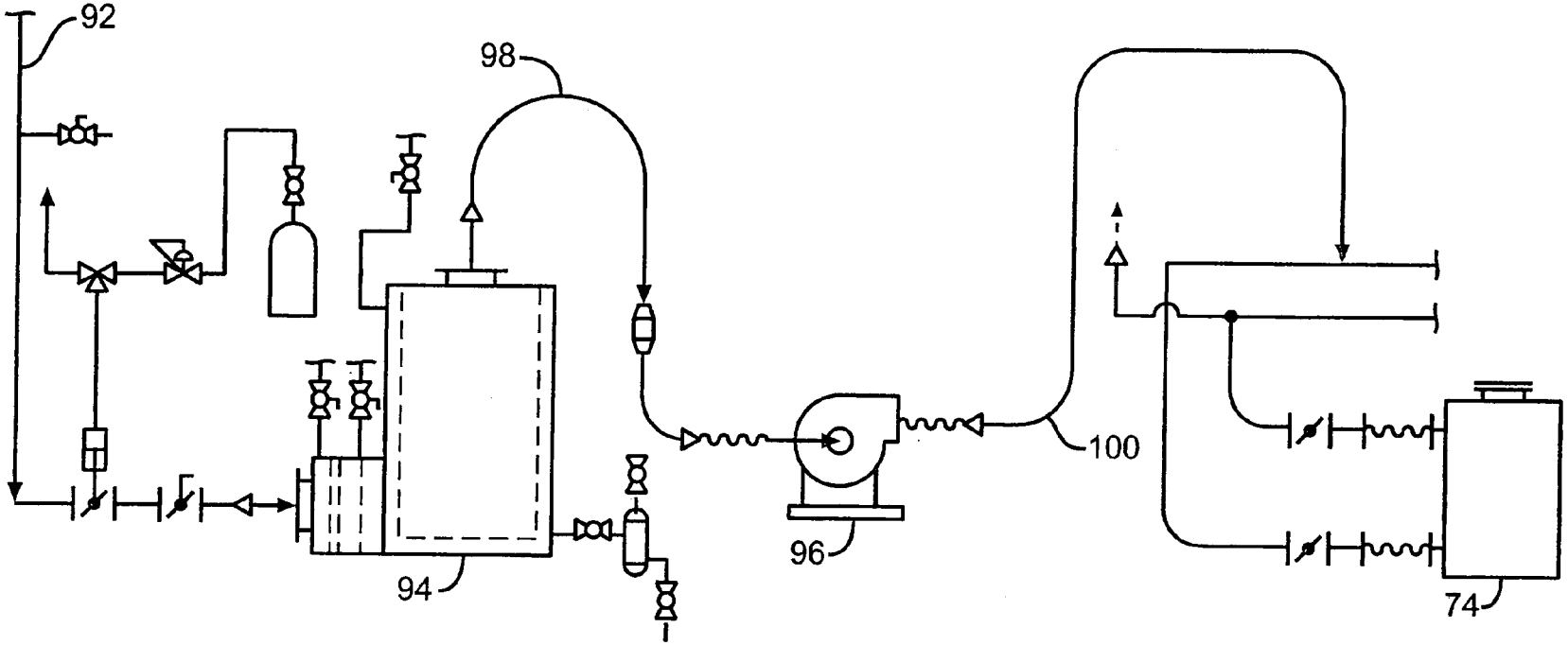
FIG. 5 is a schematic of the odor control ventilation and loading lane air valves of this invention.

FIG. 5 is a schematic of the odor control ventilation and loading lane air valves of this invention. The third stage also takes fumes from loading lanes 60 and storage tanks 40 and passes them via conduit 92 to filter 94. Filter 94 is a filter bed filter, which removes condensed vapors and particles down to plus-micron sizes. Blower 96 removes the remaining fumes via conduit 98 and passes them to carbon canister 74 via conduit 102. In this way, the carbon canisters, prefilter and filter reduce odors from the storage tanks and loading lanes.

The preceding reduces odors from storage tanks and loading facilities at asphalt terminals.

A dual carbon system was installed for the tanks and trucks. The combined system was operated continuously at a low flow rate to handle stray vapors from the tanks when they are not being filled. The system would be turned to a high flow rate based on vacuum transmitter whenever the tanks are receiving product. The collection ductwork will be an open system, allowing the tank to breathe regardless of the odor control device.

A dual carbon system is used for the loading rack. The loading rack system is operated on an as-needed basis. The blowers on this system are run at a speed proportional to the number of loading arms being used. The vapor collection system at the truck will consist of a concentric pipe around the loading spout with partial cover over the truck opening and flexible ductwork to the main collection ductwork. Actuated valves will be automatically opened when loading operations starts and automatically shut when the loading operation is complete.

Both of the systems use two initial stages of filtering to knock out most of the heavy vapors prior to running thru the carbon, as this will increase the life of the carbon. These filters consist of a coarse mesh pre-filter and a coalescing type filter. The ductwork drains will be heat traced and insulated to keep them from freezing.

In the loading rack vapor collections, each loading arm will have a fume collection hood. This could be as many as 16 loading arms or loading lanes. Each collection hood will consist of a concentric pipe around the loading spout with a partial cover over the truck opening and flexible ductwork to the main collection ductwork. The partial opening will allow visual inspection of the loading process and allow dilution air into the vapor piping. Actuated valves will start and stop vapor collection flow based on the arms being in use. The vacuum in the main collection ductwork will be maintained at the proper level by the use of variable speed drives on the blowers to assure the desired airflow through all open arms. Insulated and heat traced drain legs are provided throughout the fume system to collect condensed water and asphalt vapors. The heat trace is primarily for freeze protection.

In the tank vapor collection, the existing tank vent discharge, at the lower part of the vent pipe, has a drain leg and tee to the fume collection system. The drain leg is open at the bottom, which allows dilution air to enter and mix with the fume stream. This will cause condensation and lower the load on the abatement device. A continuous low-level airflow will be kept on the system to collect vapors that the tank may give off when the tank is not being filled. The system will be automatically switched into high flow based on vacuum transmission, when the tank is being filled. Insulated and heat traced drain legs are provided throughout the fume system to collect condensed water and asphalt vapors. The heat trace is primarily for freeze protection.

In the three (3) Stage Filtering System (Loading Lanes & Tank Vents), fume enters a stage 1 coarse mesh filter. Stage 2 is a coalescing filter which removes the large particles and condensed particles down to the plus-micron sizes. The remaining fume then enters the stage 3 carbon filter where sub-micron particles and odors are removed. The pressure differential will be monitored across all three filters, and will be used to determine when the filters need to be changed. The current method of replacing the carbon is to change out the complete carbon vessel and replace it with a new one. In another embodiment, the spent carbon is tested before removal to determine if it can be reactivated. Spent carbon is removed by a pneumatic conveying system. Carbon is delivered by truck in large super sacks and is pneumatically conveyed into the carbon chamber.

The fume collection fans are provided with a variable frequency drives, which are automatically controlled by the loading rack. Detonation arrestors and fire stop valves also have been included. A detonation arrestor also has been provided between the pre-filter and the carbon filter. The only utility required for this project is electrical power. The power requirement is less than 50 amps at 480 volts, which will come from existing motor control center.

In addition to these embodiments, persons skilled in the art can see that numerous modifications and changes may be made to the above invention without departing from the intended spirit and scope thereof.

I claim:

1. An apparatus for recovering vapors during the dispensing of liquid from a dispensing tank to a receiving tank comprising:

a vapor recovery system including two initial stages of filtering, a third carbon filter, and a variable speed blower-pulling vacuum on the vapor recovery system;

a loading arm having a spout adaptable for dispensing liquid in to the receiving tank from the dispensing tank;

a vapor recovery conduit attached to the spout for recovering vapors from the receiving tank;

a vapor recovery conduit adaptable for recovering vapors from the dispensing tank;

wherein the vapor recovery conduits for recovering vapors from the dispensing tank and the receiving tank are connected to the vapor recovery system.

2. An apparatus according to claim 1 wherein the two initial stages of filtering are a first coarse mesh pre-filter and a second coalescing filter.

3. An apparatus according to claim 1 wherein the variable speed blower is based on vacuum transmitter.

4. An apparatus according to claim 1 wherein the variable speed blower includes high speed and low speed actuation valves.

5. An apparatus according to claim 1 wherein the loading arm spout includes a vapor recovery nozzle between the spout and the vapor recovery conduit for recovering vapors from the dispensing tank.

6. An apparatus according to claim 1 including a vapor recovery hood around the loading spout partially covering the receiving tank, wherein the loading arm vapor recovery conduit is attached to the hood instead of the spout.

7. An apparatus according to claim 1 including a vapor recovery hood adjacent the dispensing tank partially covering the dispensing tank, wherein the dispensing tank vapor recovery conduit is attached to the dispensing tank vapor recovery hood instead of the dispensing tank.

8. An apparatus for recovering vapors during the dispensing of liquid from a storage tank to tank trailers comprising:

a loading arm having a spout adaptable for dispensing liquid in to the tank trailers from the storage tank;

a vapor recovery nozzle attached to the spout;

a first vapor recovery conduit attached to the spout;

a vapor recovery system including a prefilter; a second filter attached to the prefilter with a conduit; a first carbon canister attached to the second filter with a conduit; and a variable speed blower;

a vapor recovery conduit adaptable for recovering vapors from the dispensing tank;

wherein the vapor recovery conduits for recovering vapors from the storage tank and the trailers are connected to the vapor recovery system.

9. An apparatus according to claim 8 wherein the two initial stages of filtering are a first coarse mesh pre-filter and a second coalescing filter.

10. An apparatus according to claim 8 wherein the variable speed blower includes high speed and low speed actuation valves.

11. An apparatus according to claim 8 wherein the variable speed blower is based on vacuum transmission.

12. A process for recovering vapors during the dispensing of liquid from a dispensing tank to a receiving tank comprising the steps of:

providing a loading arm having a spout adaptable for dispensing liquid in to the receiving tank from the dispensing tank;

providing a vapor recover conduit to the spout;

providing a vapor recovery system including including two initial stages of filtering and a third carbon filter, a variable speed blower-pulling vacuum on the recovery system;

filtering the vapors from the loading arm spout through the first filter;

filtering the vapors from the first filter through the second filter;

filtering the vapors from the second filter through the carbon filter;

pulling a vacuum on the vapor recovery system with the variable speed blower;

providing a vapor recovery conduit to the dispensing tank;

connecting the vapor recovery conduit for the dispensing tank to the vapor recovery system;

filtering the vapors from the dispensing tank through the first filter;

filtering the vapors from the dispensing tank through the second filter; and filtering the vapors from the dispensing tank through through carbon filter.

13. A process according to claim 12 wherein the first filter is a coarse mesh pre-filter and the second filter is a coalescing filter.

14. A process according to claim 12 wherein the carbon filters are carbon canisters.

15. A process according to claim 12 wherein the blowers are run at a low speed when the tanks are not being filled.

16. A process according to claim 12 wherein the blowers are run at a high speed when the tanks are being filled.

17. A process according to claim 12 wherein the blowers are run at speeds proportional to a number of loading arms being used.

18. A process according to claim 12 wherein the variable speed blower has a speed based on vacuum transmission.

* * * * *